US008168909B2

(12) United States Patent
Kobayashi et al.

(10) Patent No.: US 8,168,909 B2
(45) Date of Patent: May 1, 2012

(54) VACUUM SWITCHGEAR

(75) Inventors: Masato Kobayashi, Hitachi (JP); Kenji Tsuchiya, Hitachi (JP); Daisuke Sugai, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 569 days.

(21) Appl. No.: 12/342,190

(22) Filed: Dec. 23, 2008

(65) Prior Publication Data

US 2009/0173719 A1 Jul. 9, 2009

(30) Foreign Application Priority Data

Jan. 7, 2008 (JP) ..... 2008-000399

(51) Int. Cl.
*H01H 33/14* (2006.01)

(52) U.S. Cl. ..... 218/5; 218/43; 218/118

(58) Field of Classification Search ..... 218/3–5, 218/43, 118–142
See application file for complete search history.

(56) References Cited

U.S. PATENT DOCUMENTS 3,441,800 A * 4/1969 Lee ..... 361/5
3,643,047 A * 2/1972 Rich ..... 218/5
3,970,809 A * 7/1976 Mitchell ..... 218/5
5,663,544 A * 9/1997 Niemeyer ..... 218/3
2005/0092713 A1 5/2005 Chyla et al.

FOREIGN PATENT DOCUMENTS

| | | |
|---|---|---|
| CN | 1618112 A | 5/2005 |
| CN | 1893210 A | 1/2007 |
| EP | 1 739 802 | 1/2007 |
| JP | 47-31194 | 8/1972 |
| JP | 2005-108766 | 4/2005 |
| JP | 2007-014087 | 1/2007 |
| KR | 2004-86824 | 10/2004 |

OTHER PUBLICATIONS

Search Report in European Patent Application No. 08021014.9-2214, dated Apr. 27, 2009.
Notice of Submission of Opinion in Korean Patent Application No. 10-2008-0136421, dated Sep. 24, 2010.
English translation of Office Action in Chinese Application No. 2009100016047 issued Jun. 15, 2011.

* cited by examiner

*Primary Examiner* — Truc Nguyen
(74) *Attorney, Agent, or Firm* — Brundidge & Stanger, P.C.

(57) ABSTRACT

A vacuum switchgear comprising a vacuum container, two fixed contacts and two movable contacts for being in contact with and out of contact with the fixed contacts which are disposed in the vacuum container, and two operation rods linked to the each movable contact, respectively, characterized that a connection conductor having a current collector for making electrical sliding contact with the external surface of the each operation rod, which is fixed to outlet parts of the vacuum containers, from which extend the operation rod outwardly.

11 Claims, 4 Drawing Sheets

VACUUM SWITCHGEAR

CLAIM OF PRIORITY

The present application claims priority from Japanese patent application JP 2008-000399 filed on Jan. 7, 2008, the content of which is hereby incorporated by reference into this application.

BACKGROUND OF THE INVENTION

1. Field of the Invention

The present invention relates to a vacuum switchgear and, more particularly, to a switchgear, having a plurality of switches accommodated in a vacuum container, that is preferably used as a power receiving and distributing facility in a power system.

2. Description of Related Art

A switchgear is provided as a power receiving and distributing facility in a power distribution system in a power system. Air-insulated switchgears have been widely used as switchgears of this type. To reduce their sizes, gas insulated switchgears, in which SF6 gas is used as the insulating medium, are being used. However, since the use of the SF6 gas as the insulating medium may cause the environment to be adversely affected, vacuum insulated switchgears, in which a vacuum is used as the insulating medium, have been proposed in recent years.

As an example of this type of vacuum insulated switchgear, a double-break type switchgear is formed by providing two fixed contacts and their corresponding movable contacts in a vacuum container, as disclosed in Patent Document 1.

Patent Document 1: Japanese Patent Laid-open No. 2007-14087

SUMMARY OF THE INVENTION

With the above-mentioned vacuum insulated switchgear having the double-break type switch, the force of a contact pressure spring provided in an operation unit needs to be sufficient to produce a contact force determined from the value of a short-circuit current at an accident so as to ensure electric conduction performance of the contacts in a vacuum atmosphere in the vacuum container. A force for operating the operation unit then needs to match the force of the contact pressure spring.

The vacuum insulated switchgear having the above-mentioned double-break type switch generates an electromagnetic repulsive force in a connection conductor that interconnects the two movable contacts disposed in the vacuum container, in a direction to open the contacts. The electromagnetic repulsive force acts on the operation unit from the connection conductor through the contact pressure spring.

To provide a contact force against the electromagnetic repulsive force between the contacts, the force of the contact pressure spring needs to be strong. When the force of the contact pressure spring is increased, the operation unit including the contact pressure spring needs to be enlarged, resulting in an increase in costs.

An object of the present invention is to provide a vacuum switchgear enable to reduce an electromagnetic repulsive force generated in a connection conductor that interconnects two movable contacts placed in parallel and prevent a contact pressure spring from becoming large.

To achieve the above object, a first invention concerns a vacuum switchgear comprising a vacuum container, two fixed contacts and two movable contacts for being in contact with and out of contact with the fixed contacts which are disposed in the vacuum container, and two operation rods linked to the each movable contact, respectively, characterized in that: a connection conductor having a current collector for making electrical sliding contact with the external surface of the each operation rod, which is fixed to outlet parts of the vacuum containers, from which extend the operation rod outwardly.

A second invention differs from the first invention in that the connection conductor is fixed to the outlet parts of vacuum containers by brazing.

A third invention differs from the first invention in that the vacuum container is provided with two, a molded portion is provided between the two vacuum containers, the connection conductor is fixed to the molded portion by a screw or another fastening for fixing the connection conductor to the outlet parts of the vacuum containers.

A fourth invention differs from the first to third inventions in that the two operation rods are linked to an insulative linking member and the insulative linking member is linked to an operation unit through an insulator.

A fifth invention differs from the first to third inventions in that the two operation rods are linked to non-conductive linking member and the non-conductive linking member is linked to an operation unit.

A sixth invention differs from the first invention in that one of the two fixed contacts and the corresponding movable contact thereof and the other fixed contact and the corresponding movable contact thereof are disposed in an each insulated tube, respectively, and these insulated tubes are placed in a common vacuum container.

A seventh invention differs from the first invention in that the vacuum container is provided with two, one of the two fixed contacts and the corresponding movable contact thereof and the other fixed contact and the corresponding movable contact thereof are disposed in an each insulated tube, respectively, and the each insulated tube is placed in the each vacuum container, respectively.

The present invention achieves a vacuum switchgear which can reduce an electromagnetic repulsive force generated in a connection conductor that interconnects two movable contacts in a double-break type switch and can prevent a contact pressure spring from becoming large, so it is possible to prevent an operation unit from becoming large and thereby reduce costs.

DETAILED DESCRIPTION OF THE PREFERRED EMBODIMENTS

Vacuum switchgears in embodiments of the present invention will be described with reference to the drawings.

Figure 1:
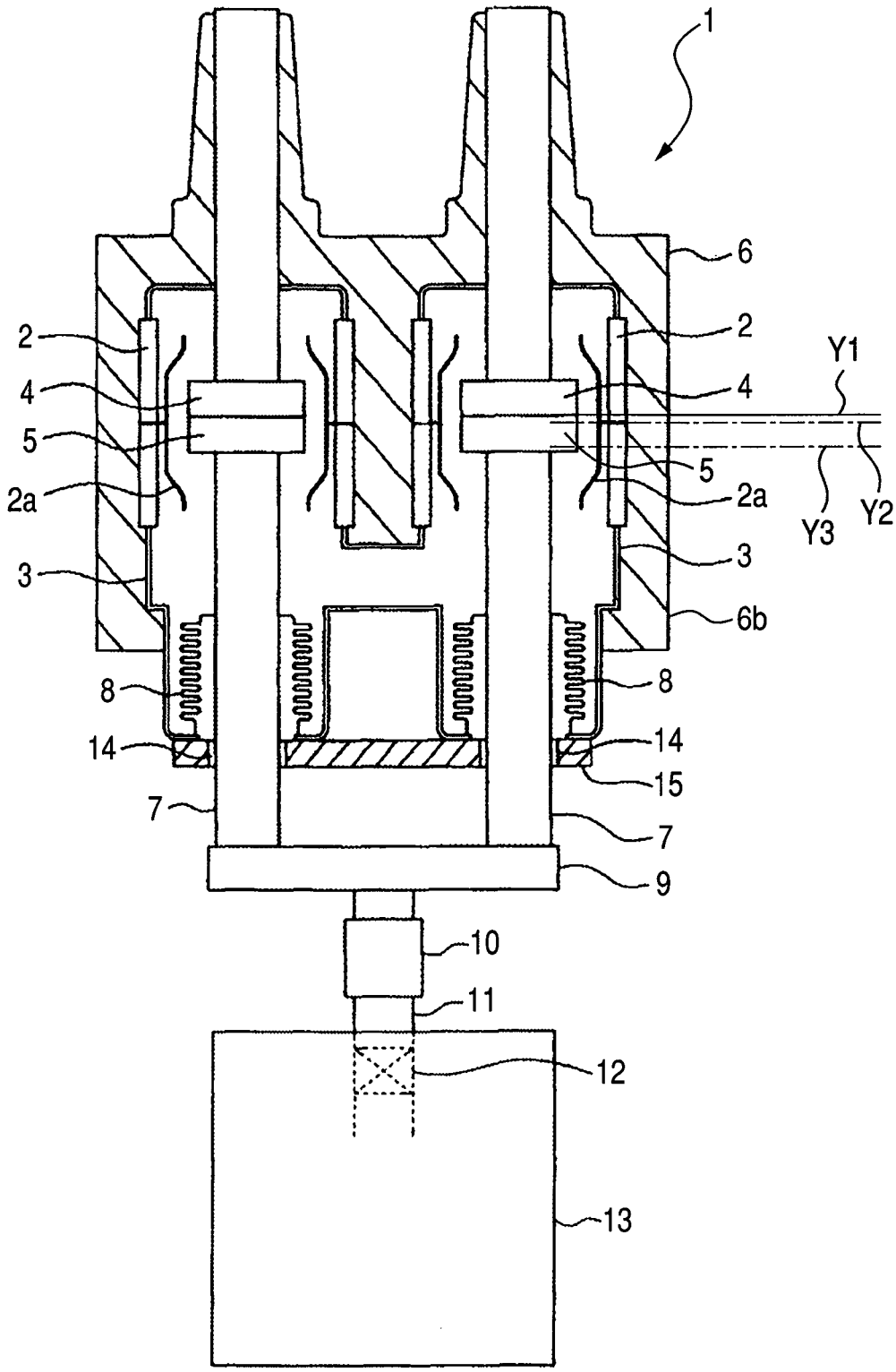
FIG. 1 is a front view showing a longitudinal cross section of a vacuum switchgear in an embodiment of the present invention.

FIG. 1 is a front view showing a longitudinal cross section of a vacuum switchgear in an embodiment of the present invention. In the embodiment of the vacuum switchgear shown in FIG. 1, the switch 1 forming the vacuum switchgear is a vacuum double-break three-position type switch. To achieve double breaking, the switch 1 comprises a vacuum container 3 having two insulated tubes 2, two fixed contacts 4, and two movable contacts 5, each of which is in contact with and out of contact with one of the two fixed contacts 4, the two fixed contacts 4 and two movable contacts 5 being disposed in the vacuum container 3.

In the embodiment, the vacuum container 3 having the two insulated tubes 2 includes the two fixed contacts 4 and two movable contacts 5. A circumference around the vicinity of the two fixed contacts 4 and two movable contacts 5, including the two fixed contacts 4 and two movable contacts 5, is covered with an arc shield 2*a*. The outer circumferential surface of the vacuum container 3 having the insulated tube 2 is a molded part 6 made of epoxy resin or the like. A conductive coating 6*b* is applied to the outer surface of the molded part 6 to ground the vacuum container 3, assuring safety when a contact is made.

One fixed contact 4, on the left side in FIG. 1, in the vacuum container 3 is connected to a bus through a feeder, and the other fixed contact 4 on the right side in FIG. 1 is connected to a cable head through another feeder.

An operation rod 7 on the left side, which is conductive, is linked to the one movable contact 5 that is in contact with and out of contact with the one fixed contact 4 on the left side, and another operation rod 7 on the right side, which is also conductive, is linked to the other movable contact 5 that is in contact with and out of contact with the other fixed contact 4 on the right side, respectively. Each operation rod 7 extends outwardly of the vacuum container 3 through a metal bellows 8. Ends of the two operation rods 7 extending outwardly of the vacuum container 3 are linked together by a linking member 9, which is insulative. The linking member 9 is linked to an operation rod 11 having an insulated body 10. The operation rod 11 is linked to an operation unit 13 through a contact pressure spring 12.

A connection conductor 15 having current collectors 14 is fixed to the vacuum container 3 at outlet parts, from which the two operation rods 7 on the left side and on the right side extend outwardly, by brazing or another means, the current collectors 14 making electrical sliding contact with the two operation rods 7 and an external surface of the vacuum switchgear.

Each of the two movable contacts 5 on the left side and on the right side is stopped by the operation rod 11 at three positions Y1, Y2, and Y3, respectively; Y1 is a closed position for flowing a current, Y2 is an open position for shutting off the current, and Y3 is a disconnecting position for ensuring the safety of a check operator against a surge voltage caused by, for example, lightning.

An operation in an embodiment of the vacuum switchgear described above will be described.

The movable contact 5 in the switch 1 is switched by operations of the operation unit 13 among the three positions; closed position Y1 for flowing a current, the open position Y2 for shutting off the current, and the disconnecting position Y3 for ensuring the safety of a check operator against a surge voltage caused by, for example, lightning.

When the movable contact 5 in the switch 1 is switched to the closed position Y1 for flowing a current by operation of the operation unit 13, that is, when the movable contact 5 is brought into contact with the fixed contact 4, a current flows into the connection conductor 15 through the collector 14. Since the connection conductor 15 is fixed to the vacuum container 3, an electromagnetic repulsive force, which is generated in the connection conductor 15 in a direction to open the contacts 4 and 5, is suppressed so that the force does not act on the operation unit 13.

Accordingly, it is unnecessary to enlarge the force of the contact pressure spring 12, which gives a contact force between the contacts 4 and 5 against the electromagnetic repulsive force. It then becomes possible to downsize the contact pressure spring 12 and the operation unit 13 including it and reduce costs.

Figure 2:
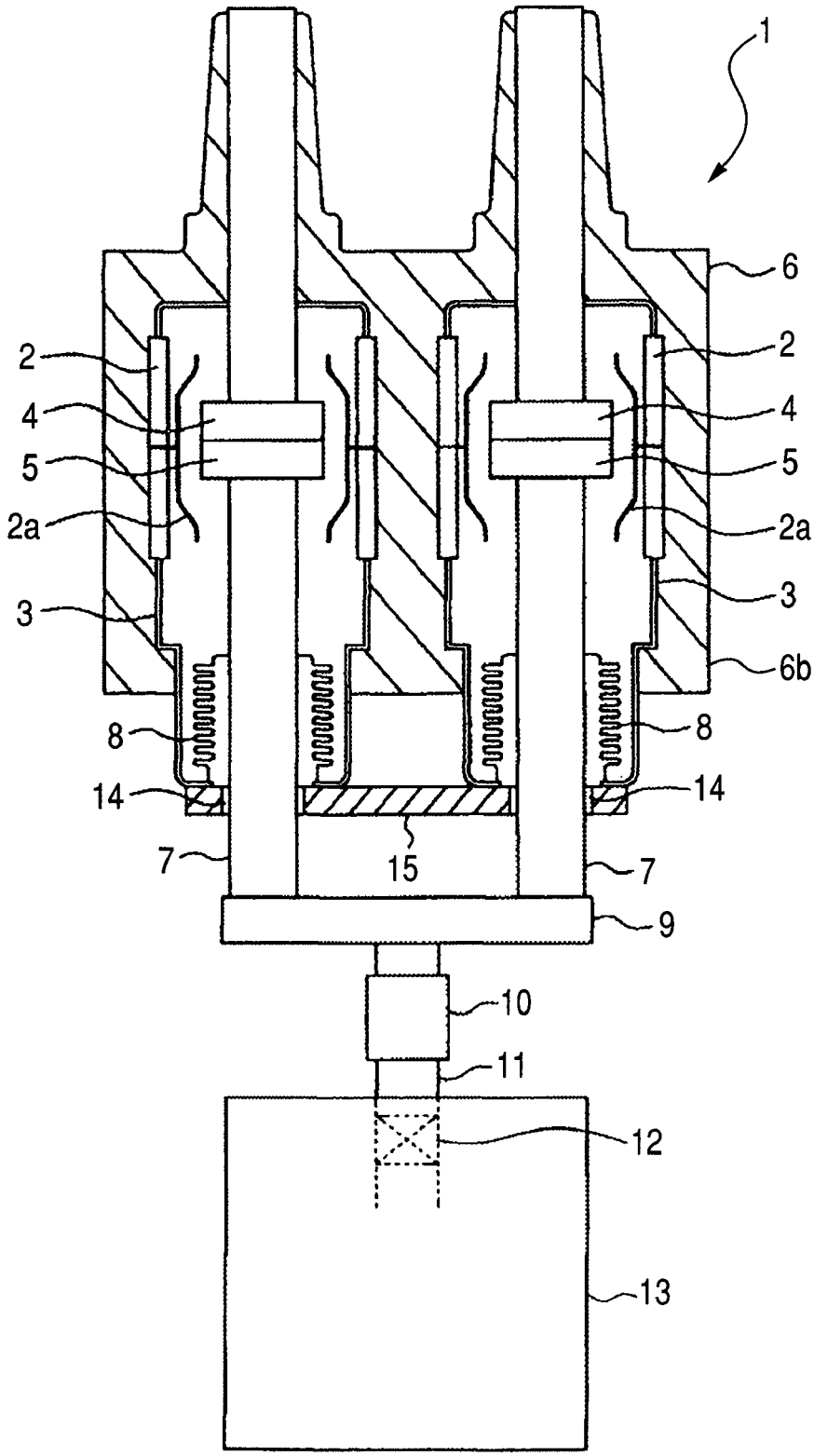
FIG. 2 is a front view showing a longitudinal cross section of a vacuum switchgear in another embodiment of the present invention.

FIG. 2 is a front view showing a longitudinal cross section of a vacuum switchgear in another embodiment of the present invention. In FIG. 2, elements identical or equivalent to elements in FIG. 1 are denoted by the same reference numerals, so their detailed explanation will be omitted. In this embodiment, one fixed contact 4 and one movable contact 5 on the left side are placed in one vacuum container 3 having an insulated tube 2, and the other fixed contact 4 and the other movable contact 5 on the right side are placed in another vacuum container 3 having an insulated tube 2. A connection conductor 15 having current collectors 14 is fixed to the vacuum containers 3 at outlet parts, from which the two operation rods 7 on the left side and on the right side extend outwardly, by brazing or another means, the current collectors 14 making electrical sliding contact with external surface of the two operation rods 7 on the left side and on the right side.

According to this embodiment, an electromagnetic repulsive force, which is generated in the connection conductor 15 in a direction to open the contacts 4 and 5, is suppressed so that the force does not act on the operation unit 13, as in the embodiment described above, so it becomes possible to prevent the contact pressure spring 12 from being enlarged. It then becomes possible to downsize the contact pressure spring 12 and the operation unit 13 including it and reduce costs. In addition, according to this embodiment, the vacuum container 3 can be manufactured more easily than in the embodiment shown in FIG. 1.

Figure 3:
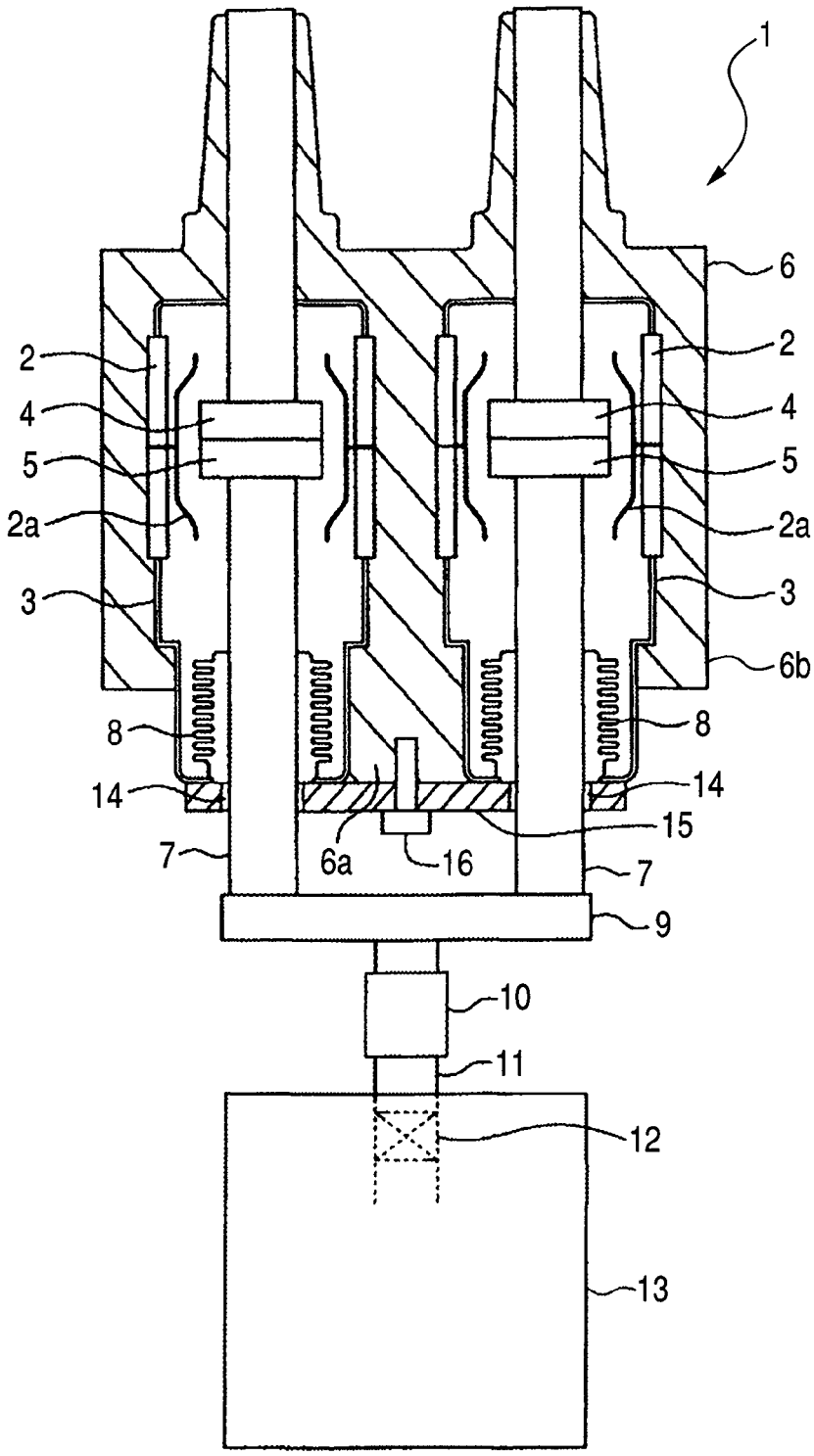
FIG. 3 is a front view showing a longitudinal cross section of a vacuum switchgear in yet another embodiment of the present invention.

FIG. 3 is a front view showing a longitudinal cross section of a vacuum switchgear in yet another embodiment of the present invention. In FIG. 3, elements identical or equivalent to elements in FIGS. 1 and 2 are denoted by the same reference numerals, so their detailed explanation will be omitted. In this embodiment, one fixed contact 4 and one movable contact 5 on the left side are placed in one vacuum container 3 having an insulated tube 2, and the other fixed contact 4 and the other movable contact 5 on the right side are placed in another vacuum container 3 having an insulated tube 2. A connection conductor 15 having current collectors 14 is fixed to the vacuum containers 3 at outlet parts, from which the two operation rods 7 extend outwardly, by using a fixing means 16 such as a screw at a molded part 6*a* between the vacuum containers 3, the current collectors 14 making electrical sliding contact with the two operation rods 7 on the left side and on the right side and an external surface of the vacuum switchgear.

According to this embodiment, an electromagnetic repulsive force, which is generated in the connection conductor 15 in a direction to open the contacts 4 and 5, is suppressed so that the force does not act on the operation unit 13, as in the embodiments described above, so it becomes possible to prevent the contact pressure spring 12 from being enlarged. It then becomes possible to downsize the contact pressure spring 12 and the operation unit 13 including it and reduce costs. In addition, according to this embodiment, the use of the fixing means 16, such as a screw, enables the connection conductor 15 to be further securely fixed to the vacuum containers 3, improving the reliability of the fixed portion. The vacuum container 3 can be manufactured more easily than in the embodiment shown in FIG. 1.

Figure 4:
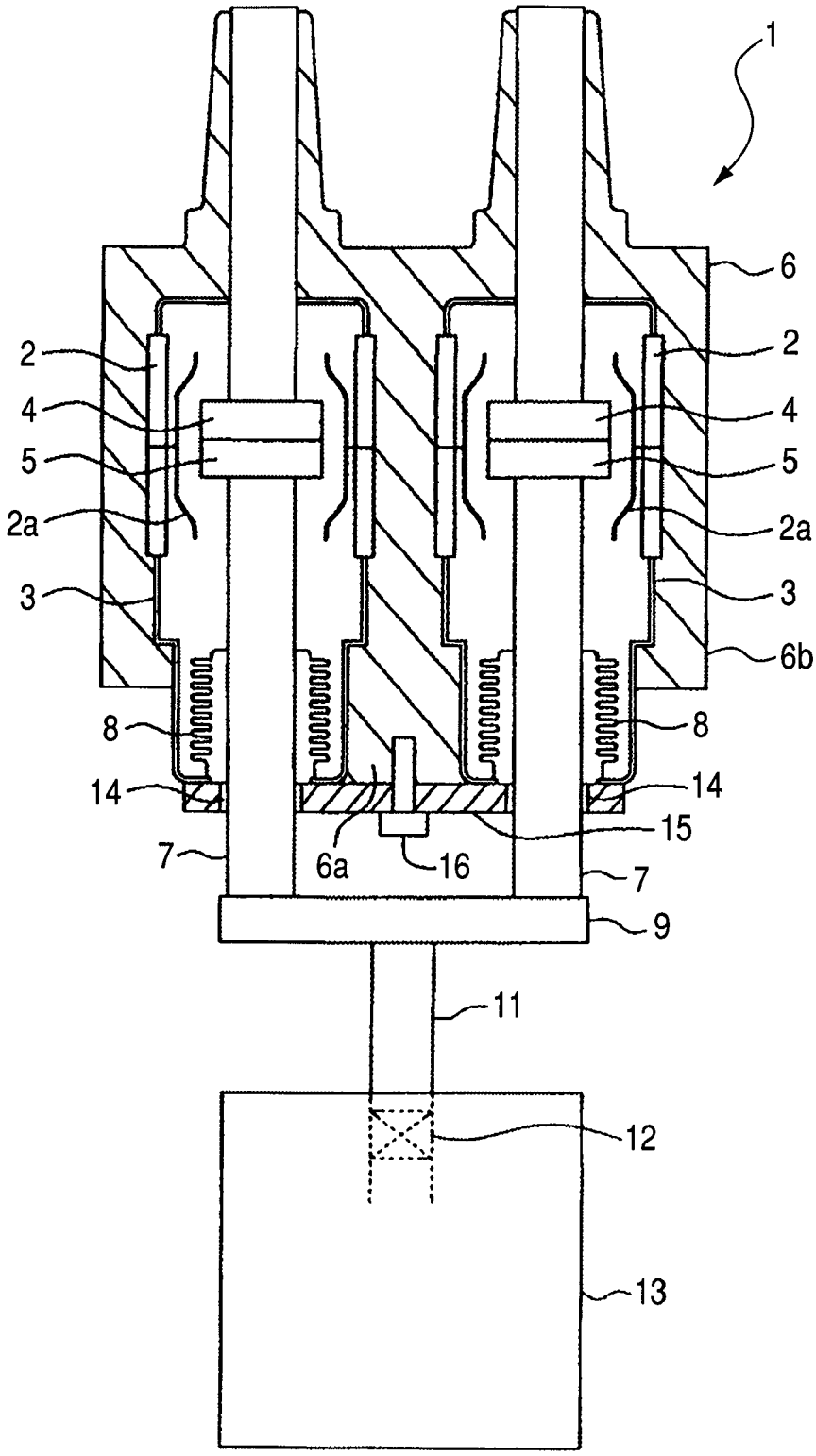
FIG. 4 is a front view showing a longitudinal cross section of a vacuum switchgear in still another embodiment of the present invention.

FIG. 4 is a front view showing a longitudinal cross section of a vacuum switchgear in still another embodiment of the present invention. In FIG. 4, elements identical or equivalent to elements in FIG. 3 are denoted by the same reference numerals, so their detailed explanation will be omitted. In this embodiment, one fixed contact 4 and one movable contact 5 on the left side are placed in one vacuum container 3 having an insulated tube 2, and the other fixed contact 4 and the other movable contact 5 on the right side are placed in another vacuum container 3 having an insulated tube 2. A connection conductor 15 having current collectors 14 is fixed to the vacuum containers 3 at outlet parts, from which the two operation rods 7 extend outwardly, by using a fixing means 16 such as a screw at a molded part 6*a* between the vacuum containers 3, the current collectors 14 making electrical sliding contact with external surface of the two operation rods 7 on the left side and on the right side. An end of each operation rod 7 is linked to the non-conductive linking member 9.

According to this embodiment, an electromagnetic repulsive force, which is generated in the connection conductor 15 in a direction to open the contacts 4 and 5, is suppressed so that the force does not act on the operation unit 13, as in the embodiments described above, and generation of a similar electromagnetic repulsive force in the linking member 9 can be suppressed, so it becomes possible to prevent the contact pressure spring 12 from being enlarged. It then becomes possible to further downsize the contact pressure spring 12 and the operation unit 13 including it and reduce costs. In addition, according to this embodiment, the use of the fixing means 16, such as a screw, enables the connection conductor 15 to be further securely fixed to the vacuum containers 3, improving the reliability of the fixed portion. The vacuum container 3 can be manufactured more easily than in the embodiment shown in FIG. 1.

The above arrangement in which the linking member 9 is non-conductive can also be applied to the embodiments shown in FIGS. 1 to 3. When the arrangement is applied, the insulated body 10 attached to the operation rod 11 can be eliminated.

What is claimed is:

1. A vacuum switchgear comprising a vacuum container, two fixed contacts and two movable contacts for being in contact with and out of contact with the fixed contacts which are disposed in the vacuum container, and two operation rods linked to the movable contacts, respectively, characterized by:

a connection conductor having a current collector for making electrical sliding contact with the external surface of each operation rod and being fixed to outlet parts of the vacuum containers, from which the operation rod extends outwardly, two vacuum containers, and a molded portion between the two vacuum containers, wherein the connection conductor is fixed to the molded portion for fixing the connection conductor to the outlet parts of the vacuum containers.

2. The vacuum switchgear according to claim 1, wherein the connection conductor is fixed to the outlet parts of the vacuum containers by brazing.

3. The vacuum switchgear according to claim 1, wherein the connection conductor is fixed to the molded portion by a screw or another fastening member for fixing the connection conductor to the outlet parts of the vacuum containers.

4. The vacuum switchgear according to claim 1, wherein the two operation rods are linked to an insulative linking member and the insulative linking member is linked to an operation unit through an insulator.

5. The vacuum switchgear according to claim 2, wherein the two operation rods are linked to a non-conductive linking member and the non-conductive linking member is linked to an operation unit.

6. The vacuum switchgear according to claim 3, wherein the two operation rods are linked to a non-conductive linking member and the non-conductive linking member is linked to an operation unit.

7. The vacuum switchgear according to claim 1, wherein the two operation rods are linked to a non-conductive linking member and the non-conductive linking member is linked to an operation unit.

8. The vacuum switchgear according to claim 2, wherein the two operation rods are linked to a non-conductive linking member and the non-conductive linking member is linked to an operation unit.

9. The vacuum switchgear according to claim 3, wherein the two operation rods are linked to a non-conductive linking member and the non-conductive linking member is linked to an operation unit.

10. The vacuum switchgear according to claim 1, wherein one of the two fixed contacts and the corresponding movable contact thereof and the other fixed contact and the corresponding movable contact thereof are disposed in an each insulated tube, respectively, and these insulated tubes are placed in a common vacuum container.

11. The vacuum switchgear according to claim 1, wherein two vacuum containers are provided, one of the two fixed contacts and the corresponding movable contact thereof and the other fixed contact and the corresponding movable contact thereof are disposed in an each insulated tube, respectively, and each insulated tube is placed in out of the two vacuum containers, respectively.

* * * * *